United States Patent [19]

Parker

[11] 3,985,312

[45] Oct. 12, 1976

[54] DRIVE CHUCK

[75] Inventor: Alexander Lovell Parker, Tenafly, N.J.

[73] Assignee: Accurate Machine and Engineering Co., Hackensack, N.J.

[22] Filed: Dec. 2, 1975

[21] Appl. No.: 636,825

[52] U.S. Cl. ..... 242/72 R

[51] Int. Cl.[2] ..... B65H 75/18

[58] Field of Search ..... 242/72, 72.1; 279/2

[56] References Cited

UNITED STATES PATENTS

| | | | |
|---|---|---|---|
| 934,964 | 9/1909 | Ethridge | 242/72 |
| 2,561,745 | 7/1951 | Lerch | 242/72 |
| 2,729,402 | 1/1956 | Kramer | 242/72 |
| 3,261,565 | 7/1966 | Hachtmann | 242/72 |

*Primary Examiner*—Edward J. McCarthy
*Attorney, Agent, or Firm*—Dominic J. Terminello

[57] ABSTRACT

A drive chuck having split sleeves moveably mounted on pins which slide/roll in slots in end members (flanges) so rotation of said chuck will urge said sleeves radially outward to engage the inside surface of a tube.

7 Claims, 8 Drawing Figures

FIG. 4
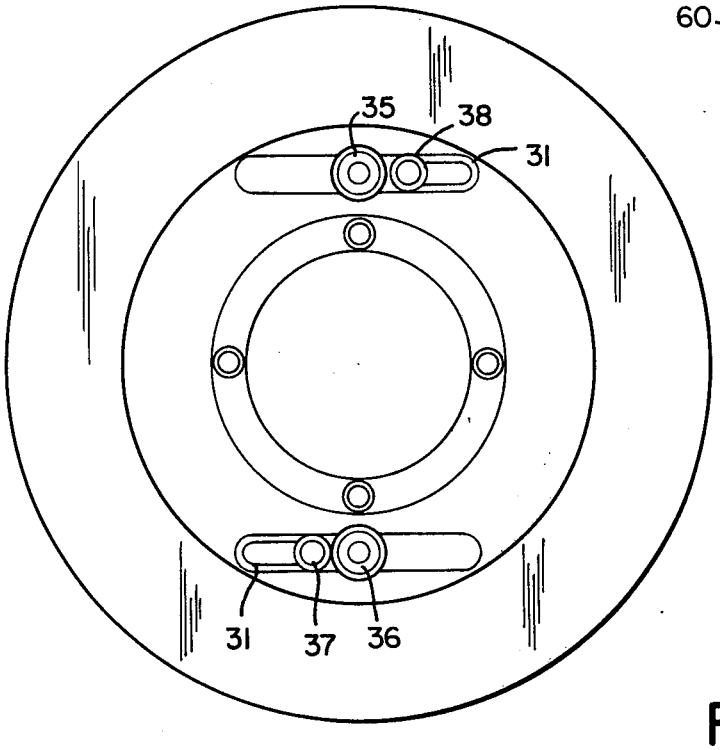
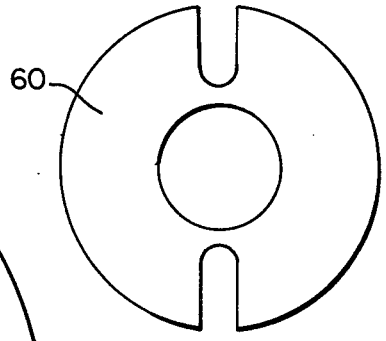
FIG. 8
FIG. 7
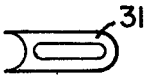
FIG. 5
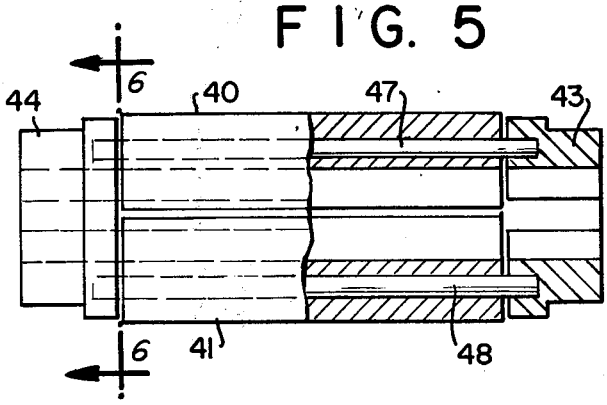
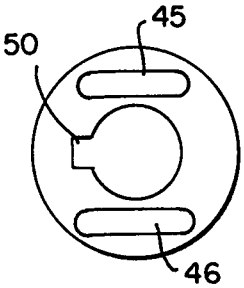
FIG. 6

DRIVE CHUCK

This invention relates to a drive chuck useful in application for winding and/or unwinding materials, such as paper, fabrics, etc. from tubes, cores or spools on which such materials are wound. More specifically, the invention relates to a drive chuck for use in driving tubes, cores or spools of relatively soft materials such as cardboard, plastics and the like.

Drive chucks of the type contemplated by the invention are used most often, by inserting them inside a tube, core or spool upon which a material is to be wound or unwound. The purpose of the chuck is to grip the tube and drive or brake the same. In many applications, such as wall paper trimming and printing machines and the like, it is critical that the paper be driven precisely without any over-ride or slip of the supply tubes.

There are many forms of drive chucks in the prior art. Most of these prior art devices are either complex, expensive or have other mechanical disadvantages.

For example, one prior art device relies on compressed air to be supplied to the interior of the chuck in order to force gripping plugs out from the chuck and against the interior surface of the tube material to grip and drive the tube. This is obviously complex, expensive to manufacture, maintain and operate, and subject to mechanical breakdown.

Accordingly, it is an object of the invention to provide a drive chuck which is simple to manufacture, inexpensive, and easy to operate and maintain.

Another object is to provide such a drive chuck which does not damage or distort relatively soft tubes such as cardboard tubes.

These and other objects will either be pointed out or become apparent from the following description and drawings wherein FIG. 1 is an exploded view of the components of one embodiment of the drive chuck of the invention;

FIG. 4 is a side elevation view showing the drive chuck with a locking mechanism;

FIG. 5 is a front elevation view shown partially in cross-section of another embodiment of the invention;

FIG. 6 is a view taken along the line 6—6 in FIG. 5.

FIG. 7 shows locking lug for use with the drive chuck of the invention and

FIG. 8 is a front elevation view of an equalizing washer.

The following detailed description of the drawings and the embodiments shown therein are merely for purposes of disclosing to those skilled in the art in the principle of the invention and should not be considered as limitation of such principle.

Figure 1:
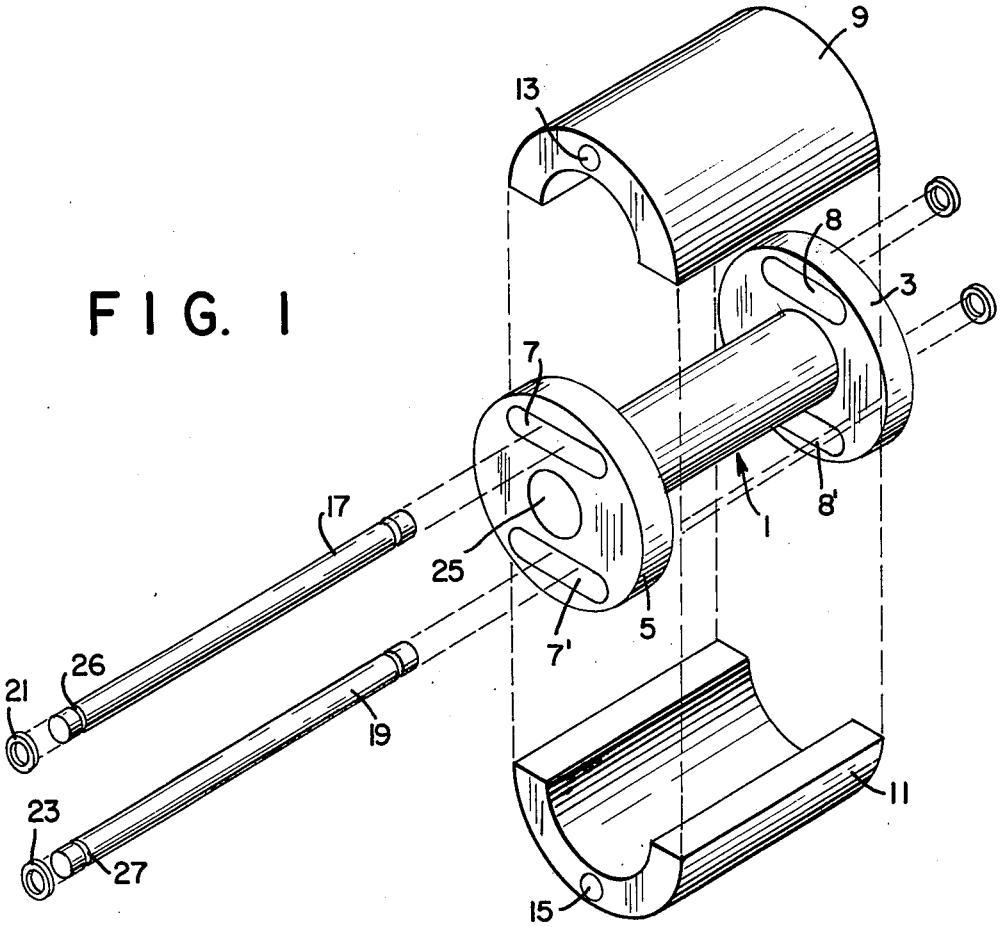

Referring to the drawings and particularly FIG. 1, a typical device of the invention includes a spool, member 1, which can be made of steel or other material. A pair of flanges 3 and 5 are either mounted on the spool or are formed as integral parts thereof. The flanges 3 and 5 are preferably circular in shape and have at least one elongated slot 7 or 8 in the area of the flange between its axis of rotation and the outer edge of the flange. Preferably each flange has two or more such elongated slots 7—7′. Each slot is positioned in the area of the flange between its axis of rotation and the edge of said flange on opposite sides of the flange diameter. Fitted on the spool member 1 are split sleeves 9 and 11, each having a passage 13 and 15, respectively therein. The minimum diameter of each sleeve should be greater than the maximum diameter of the flanges 3 and 5. Pins 17 and 19 are fitted through the slots 7—7′ in one flange, through the passages 13 and 15 and through the slots 8—8′ in the other flange. The pins are held in place by clip rings 21 and 23, fitting in grooves 26 and 27. Obviously, other equivalent means for retaining the pins may be used.

Figure 3:
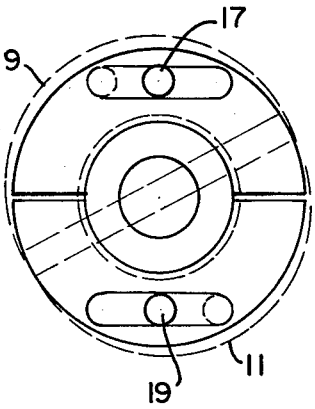
FIG. 3 is a side view of FIG. 2 showing the movement of the drive chuck in phantom when torque is supplied to the shaft.
Figure 2:
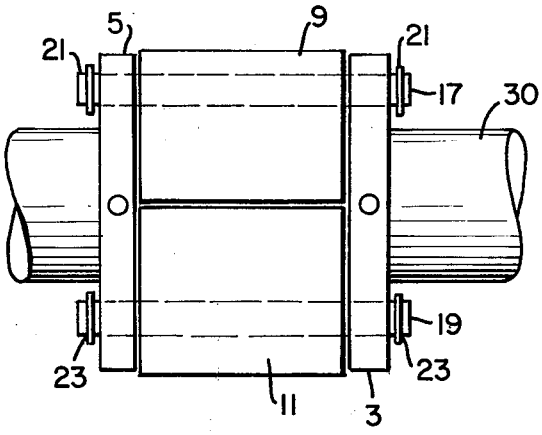
FIG. 2 is a front elevation view of the drive chuck shown in FIG. 1 mounted on a drive shaft.

In operation a drive shaft 30 (see FIG. 2) is fitted into the passage 25 in the spool member. Obviously the size of passage 25 must be such as to accommodate the size of drive shaft to be used. Likewise, the size of the drive chuck is determined by the size of the tube to be driven. The tube to be driven is then fitted over the drive chuck. When torque is applied by means of the drive shaft 30, the sleeves 9 and 11 will be forced away from the spool member 1 by movement of pins 17 and 19 in slots 7—7′ and 8—8′ respectively. The distance the sleeves move depends on the geometry of the slots. It is desirable to make the slot of such a length so that the sleeves will move out far enough to firmly engage the inside surface of the tube. FIG. 3 shows in phantom, the movement of the pins 17 and 19 and the resultant movement of the sleeves 9 and 11.

When the device of the invention is used for braking rather than driving the tube, torque is transmitted from the tube to the device by engagement of the tube with the sleeves 9 and 11, thereby transmitting torque from the sleeve to the shaft.

The sleeves may be made from any suitable material and the surfaces of such sleeves are preferably knurled and provided with a friction surface for better engagement of the inside surface of the tube. Also the sleeves should preferably have a curved surface and the curved surfaces of the pair of sleeves should have equal radii of curvature.

It will further be observed that the construction of the invention permits movement of the sleeves regardless of direction of rotation of the spool member. If desired, the slots can be designed so that movement of the sleeves occurs only on rotation in a predetermined direction. In this case the slots would extend only in one quadrant of the circular flange. Alternatively, the pins 17 and 19 can be restricted in the slots 7—7′ and 8—8′ by a locking member.

FIG. 4 shows a drive chuck similar to the one shown in FIG. 1. However, in this embodiment the drive chuck has locking lugs 31 (see FIG. 7) mounted over a portion of the slots. The rings are used to lock the pins 35 and 36 in place once the desired amount of expansion of the sleeves is obtained. The locking screws 37 and 38 are simply loosened and the locking lugs moved up to and into engagement with the pin. The screws 37 and 38 are tightened and the pins are then locked in place.

FIG. 5 shows another embodiment of the invention. In this case the sleeves 40 and 41 are not part of a spool member but would be mounted directly on the drive shaft of the motor or other device. End members 43 and 44 are provided, which are the equivalent of the flanges of the embodiment of FIG. 1. In each end member slots 45 and 46 are provided.

In operation, pins 47 and 48 are fitted through passages provided in the sleeves 40 and 41 and one end of such pins inserted into the slots machined in the end member 43, for example. The other end member 44 is then fitted onto the pins 47 and 48 to form the unit. The end members 43 and 44 of the drive chuck are keyed to the drive shaft by a keyway 50 in each end member.

It is obvious the devices of this invention are an improvement over the prior art devices presently available because they provide automatic self expansion to the diameter of the tube being driven; bi or uni directional operation; easy removal from the tube after the operation is complete; and greater surface contact with interior of the core as opposed to point contact.

As opposed to known prior art devices, the device of the invention is simply removed by rotating the tube and shaft in opposite directions relative to each other thereby urging the pins back into their original position and consequently the sleeves are positively moved to their original or minimum diameter position.

While the invention has been described with reference to several preferred embodiments, it will be understood that modifications can be made to the parts and arrangement thereof in such embodiments without departing from the spirit and scope of the invention. For example, an equalizing washer 60 such as that shown in FIG. 8 may be provided at each end of the device so that movement of one pin will automatically ensure movement of the other pin or pins thereby ensuring equal radial movement of the sleeve. This feature permits balance of the device at high rotational speeds. Further, while the sleeves are described as being cylindrical, they can, or course, be conical in shape.

What is claimed is:

1. A drive chuck comprising at least one curved sleeve adapted to be mounted on an essentially cylindrical member;

a pair of circular end members each having at least one slot therein in the area of the end member between its axis of rotation and the edge of said end member;

a pin moveably fitted in said slot and passing through the passage in said sleeve so as to hold said sleeve and end members together as a unit and to induce radial movement of said sleeve in response to rotation of said unit.

2. A drive chuck comprising a pair of curved sleeves adapted to be mounted on an essentially cylindrical member;

a passage running longitudinally in each of said sleeves;

a pair of circular flanges each having one slot therein on opposite sides of the diameter thereof in the area of the flange between its axis of rotation and the edge of said flange;

a pin moveably fitted in said slot of each of said sleeves so as to hold said sleeves and flanges together as a unit and to induce radial movement of said sleeves in response to rotation of said unit.

3. A drive chuck according to claim 2 wherein said cylindrical member is a spool and the flanges are an integral part of said spool.

4. Drive chuck according to claim 2 including means for locking said pins onto said flanges so as to prevent movement of said sleeves.

5. Drive chuck according to claim 2 wherein the said slots are positioned in said flanges so as to allow movement of said sleeves in one direction only when the chuck is rotated. .

6. Drive chuck according to claim 2 wherein equilizing washers are mounted at each end of said device so that said pins are located in guide slots in said washers.

7. Drive chuck according to claim 2 wherein said sleeves have a truncated conical cross-section.

* * * * *